United States Patent [19]

Moscrip et al.

[11] Patent Number: 4,945,813

[45] Date of Patent: Aug. 7, 1990

[54] RAPID FIRE HOWITZER

[75] Inventors: William M. Moscrip, King George Cty, Va.; Louis J. Kiraly, Brook Park, Ohio

[73] Assignee: The United States of America as represented by the Secretary of the Navy, Washington, D.C.

[21] Appl. No.: 671,847

[22] Filed: Mar. 29, 1976

[51] Int. Cl.[5] ..... F41A 9/24

[52] U.S. Cl. ..... 89/33.1; 89/40.01; 89/42.03; 89/43.01

[58] Field of Search ..... 42/6, 49 R, 49 A, 50, 42/49.01, 49.02; 89/33 B, 40 R, 40 J, 42 B, 43 R, 33.1, 40.01, 40.11, 42.03, 43.01

[56] References Cited

U.S. PATENT DOCUMENTS 565,610 8/1896 Deport ..... 89/43 R
2,359,517 10/1944 Gebeau ..... 89/33 B
3,662,649 5/1972 Williams ..... 89/40 J

FOREIGN PATENT DOCUMENTS 237869 10/1925 United Kingdom ..... 89/40 J

OTHER PUBLICATIONS

Gilbert J. Melow, Jr., "New Trends in Artillery", Ordnance, vol. L111, No. 291, Nov.-Dec. 1968, pp. 282-285.

*Primary Examiner*—Stephen C. Bentley
*Attorney, Agent, or Firm*—John D. Lewis; Kenneth W. Walden

[57] ABSTRACT

An advanced lightweight towed artillery weapon system embodying an expendable breech gun provided with a fire-out-of-battery (FOOB) recoil system which utilizes a unique constant force, zone-controlled liquid recoil spring. To facilitate rapid fire, two linear feed ammunition clips are provided to be used alternately.

3 Claims, No Drawings

RAPID FIRE HOWITZER

BACKGROUND OF THE INVENTION

This invention relates generally to artillery and more specifically to howitzers employing expendable breech guns to provide lightweight, rapid fire howitzers.

In conventional gun mechanism operation a significant portion of the total cycle time is usually given over to ramming a round into the chamber, positioning and locking the breechblock behind the round, unlocking and repositioning the breechblock after firing, and extracting the spent case from the chamber. in an expendable breech gun the cartridge case is designed to be sufficiently strong to withstand maximum breech pressure without external support. Such a case can therefore take on the function of the conventional gun chamber, serving as a one-shot breech, provided an appropriate seal is maintained between the case and the barrel while firing. The expendable breechcase can be made in the form of a simple right circular cylinder which encloses both the projectile and the propellant chamber and is open at the forward end. Low density filament-wound fiberglass/epoxy composite materials are expected to provide high specific strength at low cost in this application.

In operation the expendable breech round is mechanically locked in alignment with the barrel, supported from behind, and fired electrically. A dynamic gas seal may be maintained between the forward end of the breechcase and the face of the barrel for the duration of the pressure pulse by means of a V-shaped, plated metal, spring type ring seal bonded to the forward end of the case. The chief advantage of the expendable breech round arises from the fact that it can be positioned, fired and ejected in a single feed direction, thus eliminating conventional ramming and extraction functions as well as the mechanisms required for their accomplishment. While significantly reducing the overall mechanical complexity of the gun mechanism, the expendable breech approach also tends to produce a higher rate of fire because the number of mechanical operations are reduced and therefore less time is required to cycle each round through the gun mechanism.

SUMMARY OF THE INVENTION

The present invention is an expendable breech gun which operates on fire-out-of-battery principles and employs a liquid recoil spring system. The following elements of the present invention are described with particularity in the copending application of the present inventor, Ser. No. 606,906, Filed Aug. 20, 1975, now Pat. No. 4,084,480 and will not be discussed in detail here: (1) the expendable breech gun mechanism, (2) the expendable breech round, (3) the principles of operation of the liquid recoil spring, and (4) the principles involved in fire-out-of-battery operation.

DESCRIPTION OF THE PREFERRED EMBODIMENT

Figure 1:
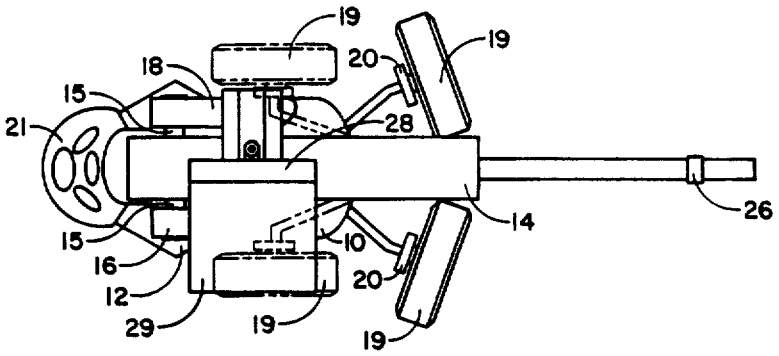
FIGS. 1, 2 and 3 are plan, side elevation, and end elevation views, respectively, of the rapid fire howitzer of the present invention.
Figure 2:
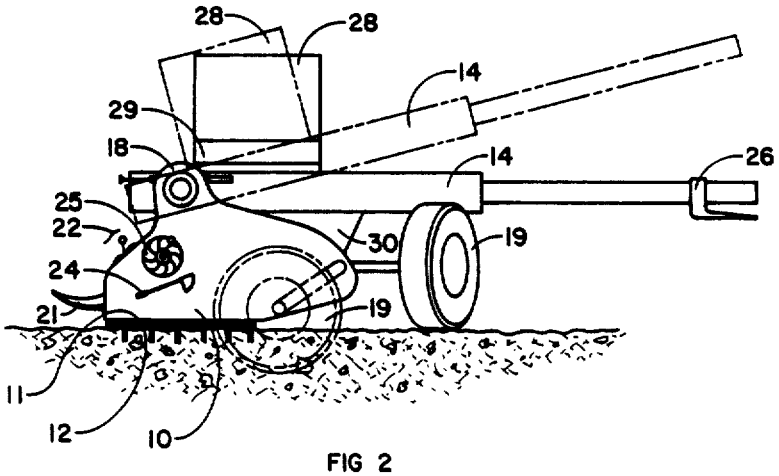
Figure 3:
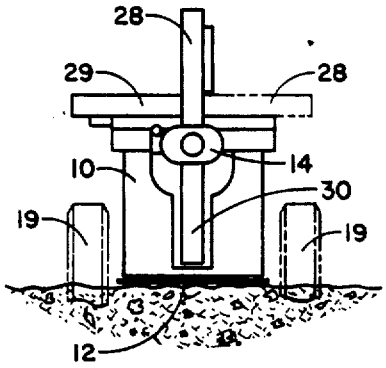

Referring first to FIGS. 1, 2 and 3, the howitzer comprises a gun mount 10 having a base ring 11 fixed to the underside thereof. A grouted bearing plate 12 is rotatably mounted on the base ring 11 by means of a large diameter ball bearing (not shown). An expendable breech gun 14 is cantilevered on the gun mount 10 by means of trunnions 15. An equilibrator 16 is provided on one trunion to balance the forces on the gun 14. An elevation actuator 18 is provided on the other trunion and is driven by the hydraulic system to be described later. A pair of wheels 19 are secured to the gun mount 10 and are movable between a firing position shown in solid lines and a towing or trail position shown in phantom. Each wheel 19 is provided with a train actuator 20 driven by the hydraulic system.

Absolute stability of the mount 10 under most firing conditions is obtained by the three point platform established by the bearing plate 12 and the wheels 19 in firing position. the grouted plate may be staked for unusual soil conditions. Minimum emplacement and disemplacement time is maintained due to the use of unlatching wheel assemblies. In the firing position the unlatched wheels provide for transverse drive and shield small arms fire. The act of jacking the wheels back into the towed position sets a mechanical safety interlock (not shown) as the gun assembly is raised from the ground. The trail position of the wheels is shown in phantom.

The gun mount 10 is provided with a collapsible operators seat 21 and an operator's control panel 22. An azimuth control lever 24 and an elevation control wheel 25 are mounted on the side of the gun mount 10. A towing lunette 26 is mounted on the barrel of the gun 14 and may be removed for firing. The gun 14 is provided with a pair of feed clips 28 and 29 which are pivotable between a horizontal loading position and a vertical firing position. As shown in FIGS. 1, 2 and 3, the clip 28 is in the firing position and the clip 29 is in the loading position where it may be loaded simultaneous with firing from the clip 28. An ejection chute 30 is mounted on the underside of the gun 30. Spent cases are ejected into this chute with sufficient velocity to carry them forward past the wheels 19 so that they do not interfere with training of the gun.

The motion of the recoiling mass within the gun 14 is primarily a function of the stroke length, the magnitudes of the mass, recoil spring force, firing impulse, and the angle of elevation. If the recoil spring force is constant over a given stroke length, and the other variables are such that the pure FOOB recoil condition obtains, it is theoretically possible to achieve a 75% reduction in the brake load applied to the trunnions 15 as compared to an equivalent conventional recoil system. A practical FOOB recoil system must be designed to accommodate changes in elevation angle and, in the howitzer application, changes in the expected firing impulse (due to different zone charges). Since the recoiling mass is essentially unchanging during the firing cycle, provision must be made to adjust either the effective stroke length or the magnitude of the recoil spring force.

Figure 4:
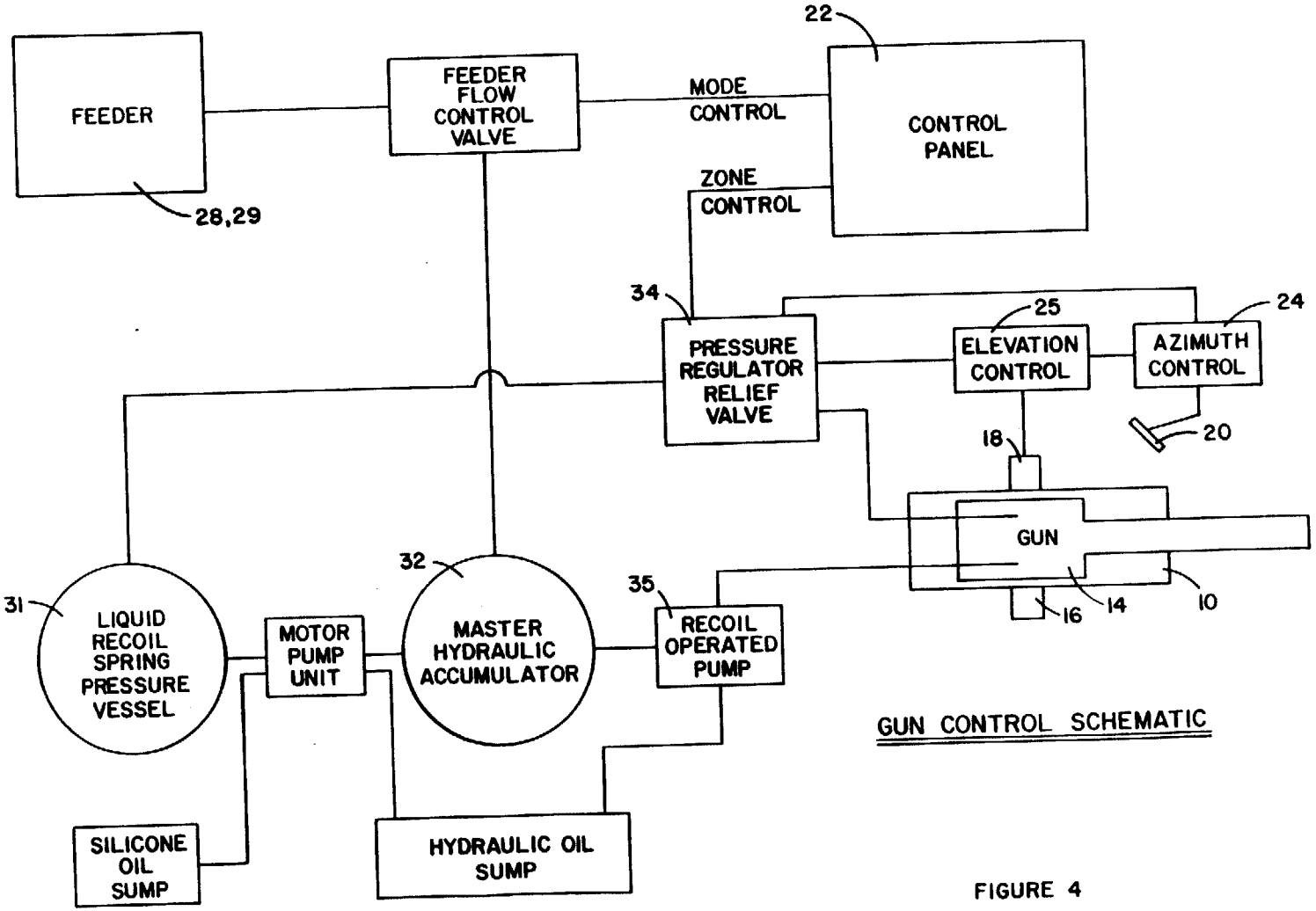
FIG. 4 is a schematic representation of the gun control system including both the liquid spring system and the hydraulic system.

As in ordinary liquid springs, the force level of a constant-force liquid recoil spring can be changed by adjusting the amount of initial fluid precompression. This is accomplished by pumping a given amount of silicone fluid into or out of the liquid recoil spring pressure vessel 31. As shown by the schematic of FIG. 4, power to adjust the liquid recoil spring is derived from a master hydraulic accumulator 32 which also provides power to the gun feed mechanism. The requisite liquid recoil spring pressure for a given elevation angle and selected zone charge is controlled by mechanical pressure regulator and relief valves 34 set by the operator from a central control panel at 22 the rear of the weapon. The fluid energy extracted from the hydraulic accumulator 32 is replenished as each round is fired by a positive displacement hydraulic pump 35 coupled to the recoiling mass.

OPERATION

In order that a better understanding of the invention may be had, its mode of operation wil now be described. From the trail position emplacement of the weapon is accomplished by unlatching the wheel assemblies 19 from the towed position and allowing the gun assembly to be lowered to the ground on the grouted bearing plate 12. The muzzle lunette 26 is detached from the towing vehicle. The gunner then takes a seated position at the rear of the weapon and points the weapon to the target by means of the elevation 25 and train 24 controls provided. Level and cross-level capability is also provided, and all mount control functions are executed by the gunner from the centralized control panel 22 directly in front of him. Firing of the gun in both direct and indirect fire modes can be accomplished by a single operator.

Ammunition is fed into the gun mechanism from a hydraulically actuated clip feeder mounted on top of the slide, or gun housing. There are two such feeders 28, 29 which are hinged in such a way as to permit them to fold down to a horizontal position on either side of the gun. The clips are designed to be loaded through the top, and one clip 29 can be loaded from the side of the gun while the other 28 is being fired. The empty breechcases are ejected from the bottom of the gun and are deflected toward the area forward of the gun by a curved chute 30 over the ejection port. The gunner has a mode selection control for either semi-automatic or full automatic fire.

When it becomes necessary to move the weapon to a new site the towing vehicle is moved into position and the lunette 26 is attached. The wheels 19 are then released from the firing configuration and jacked into the towing configuration. The wheels are then latched in the towed position and the weapon is ready for transport.

Obviously many modifications and variations of the present invention are possible in the light of the above teachings. It is therefore to be understood that within the scope of the appended claims the invention may be practiced otherwise than as specifically described.

What is claimed is:

1. A light weight raped fire howitzer comprising:

a gun mount having a base ring on the underside thereof;

a grouted bearing plate rotatably mounted on the underside of said base ring;

a pair of wheels on said gun mount and movable between trail and firing positions;

an expendable breech gun trunnion mounted in cantilevered fashion on said gun mount and movable thereon in elevation;

a pair of feed clips mounted on the top of said gun and pivotable between a vertical feed position and a horizontal load position to enable firing from one clip while loading the other;

an ejection chute for expended breechcases fixed to the underside of said gun;

a substantially constant force liquid recoil spring system; and a recoil operated hydraulic system for driving said wheels when they are in the firing position to rotate said gun mount in train about the axis of said base ring and bearing plate.

2. A howitzer as defined in claim 1 wherein an equilibrator is provided on one of the gun trunnions to balance the forces caused by the cantilevered mounting.

3. A howitzer as defined in claim 2 wherein a hydraulic elevation actuator is provided on the other one of the gun trunnions and operated by said hydraulic system.

* * * * *

UNITED STATES PATENT AND TRADEMARK OFFICE
CERTIFICATE OF CORRECTION

PATENT NO. : 4,945,813

DATED : August 7, 1990

INVENTOR(S) : Moscrip et al.

It is certified that error appears in the above-identified patent and that said Letters Patent is hereby corrected as shown below:

The title page should be deleted to appear as per attached title page.

The sheets of drawing consisting of figures 1-4 should be added as per attached sheets.

Signed and Sealed this

Third Day of September, 1991

*Attest:*

HARRY F. MANBECK, JR.

*Attesting Officer*

*Commissioner of Patents and Trademarks*

United States Patent [19]

Moscrip et al.

[11] Patent Number: 4,945,813

[45] Date of Patent: Aug. 7, 1990

[54] RAPID FIRE HOWITZER

[75] Inventors: William M. Moscrip, King George Cty, Va.; Louis J. Kiraly, Brook Park, Ohio

[73] Assignee: The United States of America as represented by the Secretary of the Navy, Washington, D.C.

[21] Appl. No.: 671,847

[22] Filed: Mar. 29, 1976

[51] Int. Cl.[3] ..... F41A 9/24

[52] U.S. Cl. ..... 89/33.1; 89/40.01; 89/42.03; 89/43.01

[58] Field of Search ..... 42/6, 49 R, 49 A, 50, 42/49.01, 49.02; 89/33 B, 40 R, 40 J, 42 B, 43 R, 33.1, 40.01, 40.11, 42.03, 43.01

[56] References Cited

U.S. PATENT DOCUMENTS 565,610 8/1896 Deport ..... 89/43 R
2,359,517 10/1944 Gebeau ..... 89/33 B
3,662,649 5/1972 Williams ..... 89/40 J

FOREIGN PATENT DOCUMENTS 237869 10/1925 United Kingdom ..... 89/40 J

OTHER PUBLICATIONS

Gilbert J. Melow, Jr., "New Trends in Artillery", Ordnance, vol. L111, No. 291, Nov.-Dec. 1968, pp. 282-285.

*Primary Examiner*—Stephen C. Bentley
*Attorney, Agent, or Firm*—John D. Lewis; Kenneth W. Walden

[57] ABSTRACT

An advanced lightweight towed artillery weapon system embodying an expendable breech gun provided with a fire-out-of-battery (FOOB) recoil system which utilizes a unique constant force, zone-controlled liquid recoil spring. To facilitate rapid fire, two linear feed ammunition clips are provided to be used alternately.

3 Claims, 2 Drawing Sheets

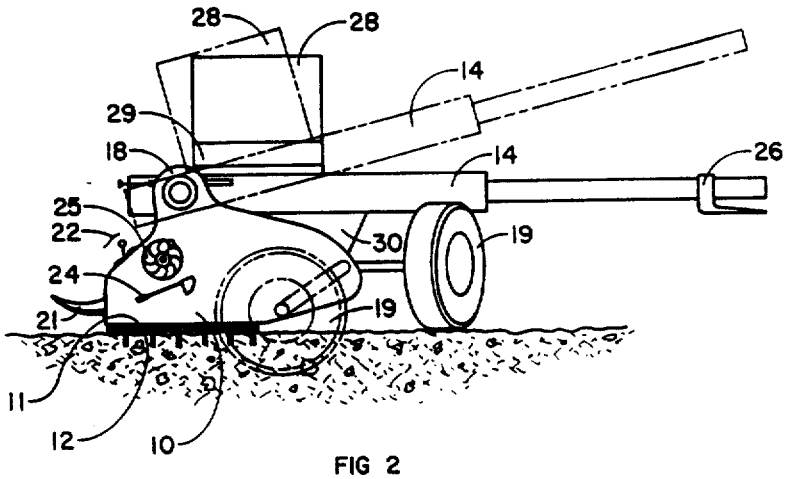

FIG 2

GUN CONTROL SCHEMATIC